US009234511B2

(12) United States Patent
Hopley

(10) Patent No.: US 9,234,511 B2
(45) Date of Patent: Jan. 12, 2016

(54) HOUSING WITH INTERSECTING PASSAGES FOR HIGH PRESSURE FLUID APPLICATIONS

(75) Inventors: Daniel Jeremy Hopley, Chislehurst (GB); Joanne Hopley, legal representative, Chislehurst (GB)

(73) Assignee: Delphi International Operions Luxembourg S.A.R.L., Luxembourg (LU)

( * ) Notice: Subject to any disclaimer, the term of this patent is extended or adjusted under 35 U.S.C. 154(b) by 270 days.

(21) Appl. No.: 13/502,824

(22) PCT Filed: Nov. 8, 2010

(86) PCT No.: PCT/EP2010/066970

§ 371 (c)(1),
(2), (4) Date: May 22, 2012

(87) PCT Pub. No.: WO2011/054948

PCT Pub. Date: May 12, 2011

(65) Prior Publication Data

US 2012/0234403 A1 Sep. 20, 2012

(30) Foreign Application Priority Data

Nov. 6, 2009 (EP) ..... 09175226

(51) Int. Cl.

| | |
|---|---|
| ***F04B 1/04*** | (2006.01) |
| ***F02M 59/02*** | (2006.01) |
| ***F02M 59/44*** | (2006.01) |
| ***F02M 63/02*** | (2006.01) |
| ***F04B 11/00*** | (2006.01) |

(Continued)

(52) U.S. Cl.

CPC ..... *F04B 1/0404* (2013.01); *F02M 59/02* (2013.01); *F02M 59/44* (2013.01);

(Continued)

(58) Field of Classification Search

USPC ..... 251/366; 92/169.1, 163, 164; 415/182.1; 417/364, 415, 454, 559, 417/470, 571, 569; 137/884; 123/469, 445, 123/495

See application file for complete search history.

(56) References Cited

U.S. PATENT DOCUMENTS 5,127,437 A * 7/1992 Ross, II ..... 137/614.18
5,192,026 A * 3/1993 Rix et al. ..... 239/533.3

(Continued)

FOREIGN PATENT DOCUMENTS

CN 1335913 A 2/2002
CN 1490515 A 4/2004

(Continued)

OTHER PUBLICATIONS

International Search Report dated Jan. 26, 2011.

*Primary Examiner* — William McCalister
*Assistant Examiner* — Ian Paquette
(74) *Attorney, Agent, or Firm* — Thomas H. Twomey

(57) ABSTRACT

A housing for use in high pressure fluid applications comprises a first drilling having a region of enlarged diameter bounded by an upper boundary in a first plane and a lower boundary in a second plane; and a second drilling intersecting with the first drilling via an intersection region. The intersection region includes a first substantially flat surface which defines a ceiling of the intersection region and which intersects the upper boundary of the region of enlarged diameter, and a second substantially flat surface which is opposed to the first substantially flat surface and which defines a floor of the intersection region and intersects the lower boundary of the region of enlarged diameter. As the flat surfaces are in alignment with a region of maximum hoop stress they do not act as a significant stress raiser at the intersection.

10 Claims, 5 Drawing Sheets

Section B-B

(51) Int. Cl.

| | |
|---|---|
| ***F04B 17/05*** | (2006.01) |
| ***F04B 53/00*** | (2006.01) |
| ***F04B 53/16*** | (2006.01) |

(52) U.S. Cl.

CPC ..... *F02M 63/0265* (2013.01); *F04B 1/0421* (2013.01); *F04B 11/0091* (2013.01); *F04B 17/05* (2013.01); *F04B 53/007* (2013.01); *F04B 53/16* (2013.01); *F04B 53/162* (2013.01); *Y10T 137/6851* (2015.04)

(56) References Cited

U.S. PATENT DOCUMENTS

| | | | | | |
|---|---|---|---|---|---|
| 5,819,808 | A * | 10/1998 | Smith | ..... | 138/177 |
| 5,992,904 | A * | 11/1999 | Hitachi et al. | ..... | 285/332 |
| 6,427,665 | B1 | 8/2002 | Knoedl et al. | | |
| 6,666,188 | B2 | 12/2003 | Knoedl et al. | | |
| 7,278,400 | B2 * | 10/2007 | Denton et al. | ..... | 123/456 |
| 7,478,582 | B2 * | 1/2009 | Kubota et al. | ..... | 92/86 |
| 8,608,093 | B2 * | 12/2013 | Girlinger et al. | ..... | 239/584 |
| 2001/0005485 | A1 | 6/2001 | Mori | | |
| 2004/0080156 | A1 | 4/2004 | Usui | | |
| 2006/0260124 | A1 | 11/2006 | Usui | | |
| 2008/0282879 | A1 | 11/2008 | Arnold et al. | | |

FOREIGN PATENT DOCUMENTS

| | | | |
|---|---|---|---|
| DE | 102 23 730 | | 2/2003 |
| DE | 10 2005 050613 | | 4/2006 |
| DE | 102008040383 | A1 * | 1/2010 |
| EP | 1 927 751 | | 6/2008 |
| GB | 2285096 | A * | 6/1995 |
| JP | 2002-168158 | A | 6/2002 |

* cited by examiner

Section B-B

HOUSING WITH INTERSECTING PASSAGES FOR HIGH PRESSURE FLUID APPLICATIONS

TECHNICAL FIELD

The invention relates to a housing for use in high pressure fluid applications comprising intersecting drillings or passages. In particular, the invention relates to the shape of the housing in the region of the intersection of the passages. The invention has applications in, but is not limited to, the field of high pressure pumps for automotive applications. In particular, but not exclusively, the invention relates to a part of a pump assembly for a common rail compression-ignition (diesel) internal combustion engine having a shaped intersection between high pressure drillings.

BACKGROUND TO THE INVENTION

One problem often encountered when designing and operating engineering components having intersecting passages is that stress concentrations arise at the intersections or transitions between the passages when the passages are under pressure. For example, in hydraulic applications such as pumps, the passages carry high-pressure fluid which acts upon the walls of the passages to create high stress concentrations, which can lead to failure of the component by fatigue close to or at the intersection. In some applications, such as common rail fuel pumps, the stresses generated can be extremely high due to the considerable pressure of fuel that is generated within the pump.

FIG. 1(*a*) shows part of a known pump assembly for use in a common rail diesel engine. The pump assembly includes a pump housing 10 provided with a blind bore 12 within which a pumping plunger (not shown) reciprocates, in use, under the influence of a drive arrangement (also not shown). The plunger and its bore 12 extend co-axially through the pump housing 10 with the upper region of the bore defining a pump chamber 14 for fuel. Fuel at relatively low pressure is delivered to the pump chamber 14 through an inlet passage 16 under the control of an inlet non-return valve (not shown). Fuel is pressurised within the pump chamber 14 as the plunger reciprocates within the bore 12 and, once pressure reaches a predetermined level, fuel is delivered to an outlet passage, referred to generally as 18, via an outlet valve (not shown), which extends transversely to the bore 12. The outlet passage 18 intersects with the plunger bore 12 in a recess 20 which has an enlarged diameter compared with the diameter along the remainder of the bore. The outlet passage 18 delivers pressurised fuel to a downstream common rail of the fuel injection system.

Due to the high pressures that are generated cyclically within the pump chamber 14 during the pumping cycle, one problem that may occur within the pump assembly of the aforementioned type is high pressure fatigue of parts due to the increased stress in the region of intersection between the plunger bore 12, 20 and the outlet passage 18. As the plunger reciprocates within its bore 12 and fuel is pressurised to a high level within the pump chamber 14, a pulsating tensile stress occurs within the pump housing 10 that can cause cracks to grow. The pulsating tensile stress has two main effects within the pump housing 10: hoop stress acts around the perimeter of the plunger bore 12, 20 particularly in the vicinity of the pump chamber 14, and axial stress acts along the length of the plunger bore 12, 20.

It has previously been shown that the stress concentrations at the intersection between fluid passages can be reduced by shaping the intersection at the end of one passage, for example by radiusing the intersection to reduce the presence of sharp features and thin regions of material at the intersection. FIG. 1(*b*) shows a cross section of the pump assembly to illustrate the radiusing of the intersection between the outlet passage 18 and the plunger bore recess 20. At its intersecting end, the outlet passage 18 includes a conical surface 22 and terminates in a blend radius 24 between the cone 22 and the plunger bore recess 20.

The Applicant's granted European Patent No. EP 06256052 describes a more sophisticated shaping of the intersection which may be used between the outlet passage and the plunger bore in a high pressure common rail to further reduce the stress concentrations where the outlet passage meets the plunger bore. The solution proposes an intersection region which flares towards the plunger bore with a generally rectangular shape, with a radius being provided on the flare to smooth the transition between the flare and the plunger bore.

Whilst these approaches have been successful in high pressure pump applications operating to a certain pressure level, at the increasingly high pressures demanded of current common rail pumps the stress concentration at the intersecting region is not reduced enough to reduce the fatigue problem appreciably.

It is an object of the present invention to provide a high pressure fuel pump, and more generally a housing for high-pressure fluid applications, in which the stress concentrations between intersecting passages are reduced further compared to known solutions.

SUMMARY OF THE INVENTION

According to a first aspect of the present invention, there is provided a housing for use in high pressure fluid applications, the housing comprising a first drilling defining a first axis and having a region of enlarged diameter bounded by an upper boundary in a first plane and a lower boundary in a second plane; and a second drilling defining a second axis and intersecting with the first drilling via an intersection region. The intersection region includes a first substantially flat surface which defines a ceiling of the intersection region and which intersects the upper boundary of the region of enlarged diameter, and a second substantially flat surface which is opposed to the first substantially flat surface and which defines a floor of the intersection region and intersects the lower boundary of the region of enlarged diameter.

It is preferable for the first and second substantially flat surfaces to intersect with the upper and lower boundaries, respectively, at substantially 90 degrees so as to align with the plane of a respective one of the upper and lower boundaries. The flat surfaces are therefore parallel with one another. In this way the flat surfaces are in alignment with the region of maximum hoop stress (i.e. at the upper and lower boundaries of the enlarged diameter region) and so do not act as a significant stress raiser at the intersection.

The intersection region includes side walls which may include first and second opposed tangential surfaces which form a tangent to the circumference of the first drilling. In addition, or alternatively, the intersection region may include first and second opposed radiused surfaces to define the side walls of the intersection region.

Each of the first and second opposed radiused surfaces preferably forms a tangent to a respective one of the first and second opposed tangential surfaces.

The invention has particular application in a fuel pump assembly, for example a pump head for a main pump housing, wherein the first drilling is a bore for receiving a pumping plunger and the second drilling is a passage for conveying high pressure fuel, in use, from the plunger bore to a pump outlet (e.g. an outlet passage). In this case, the enlarged diameter region forms a plunger bore recess within which a pump chamber is defined for pressurising fuel. In recognising that the intersection can be formed with upper and lower flat surfaces that align with the boundaries of the plunger bore recess, rather than breaking into the wall of the plunger bore recess as is known in the prior art, the region of concentrated hoop stress is avoided by the intersection and, hence, fatigue and failure of parts can be significantly reduced.

It is a further benefit that the depth of the plunger bore recess is substantially the same as the diameter of the outlet passage and so the dead volume of the pump chamber is reduced compared with known arrangements.

In an alternative embodiment, the intersection region may be tapered, with the direction of taper such that the first and second substantially flat surfaces are divergent at their intersection with the upper and lower boundaries of the enlarged diameter region, respectively. Alternative, the direction of taper is such that the first and second substantially flat surfaces are convergent at their intersection with the upper and lower boundaries of the enlarged diameter region, respectively.

Preferably, the first and second substantially flat surfaces are of triangular-like form i.e. they have three sides linked end to end to form a three-sided polygon, even if the sides are not exactly straight. For example each of the first and second substantially flat triangular-like surfaces may have a base which connects with the respective one of the upper and lower boundaries and a vertex opposite to the base which intersects with an end of the second drilling.

It is convenient for the first and second axes of the first and second drillings, respectively, to intersect with one another, although this need not be the case.

In a particularly preferred embodiment of the invention, there is provided a housing for a fuel pump assembly, wherein the first drilling is a bore for receiving a plunger of the pump and the second drilling is a passage for conveying high pressure fuel, in use, from the plunger bore to a pump outlet.

According to a second aspect of the present invention, there is provided a housing for use in high pressure fluid applications comprising a first drilling defining a first axis and a second drilling defining a second axis and intersecting with the first drilling via an intersection region. The intersection region includes side walls defined by first and second opposed tangential surfaces which form a tangent to the circumference of the first drilling. A first substantially flat surface defines a ceiling of the intersection region and a second substantially flat surface, which is opposed to the first substantially flat surface, defines a floor of the intersection region.

In one embodiment, the side walls further include first and second opposed radiused surfaces, each of which forms a tangent to a respective one of the first and second opposed tangential surfaces.

In this arrangement, because the intersection region is at a tangent to the circumference of the first drilling, the intersection region does not interfere with the hoop stress of the first drilling.

It will be appreciated that preferred and/or optional features of the first aspect of the invention may be incorporated alone or in appropriate combination within the second aspect of the invention also.

Figure 1A:
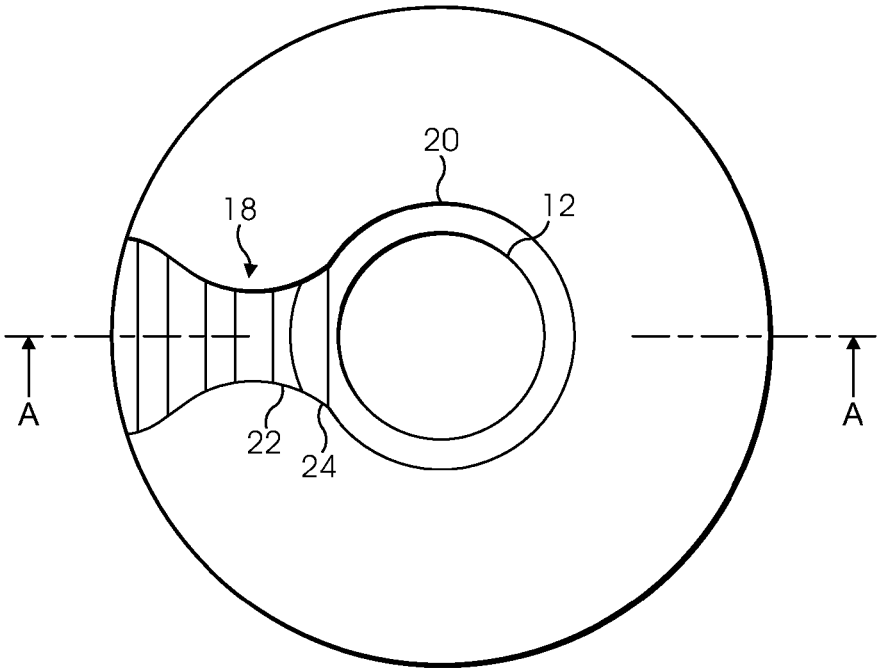
FIG. 1(a) PRIOR ART
FIG. 1(*a*), which has already been described, shows a cross section of a part of a known pump assembly of a common rail fuel pump to illustrate the region of intersection between an outlet drilling for high pressure fuel and a plunger bore recess, and FIG. 1(*b*) shows a cross-section of the same part of the pump assembly, along line A-A.
Figure 1B:
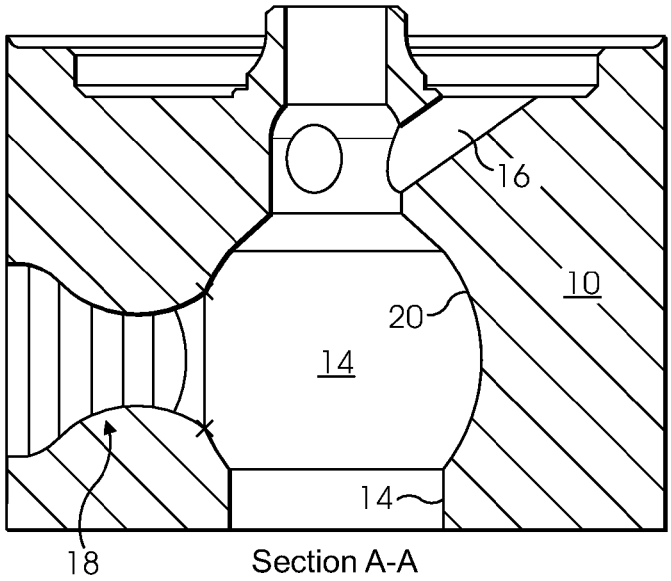
FIG. 1(b) PRIOR ART
Figure 2A:
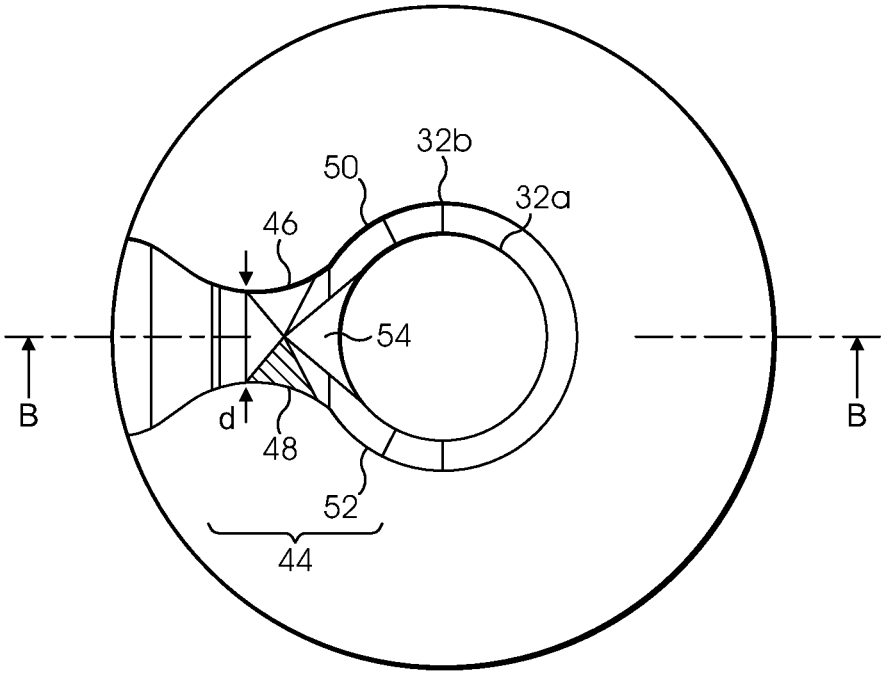
Figure 2B:
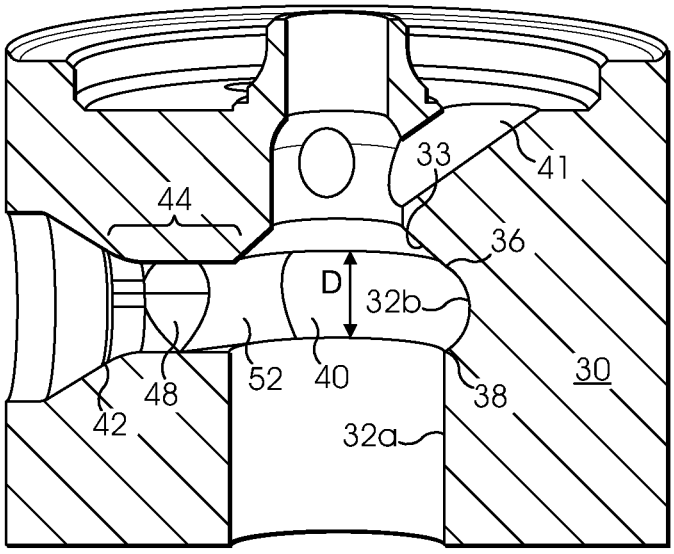
Figure 3:
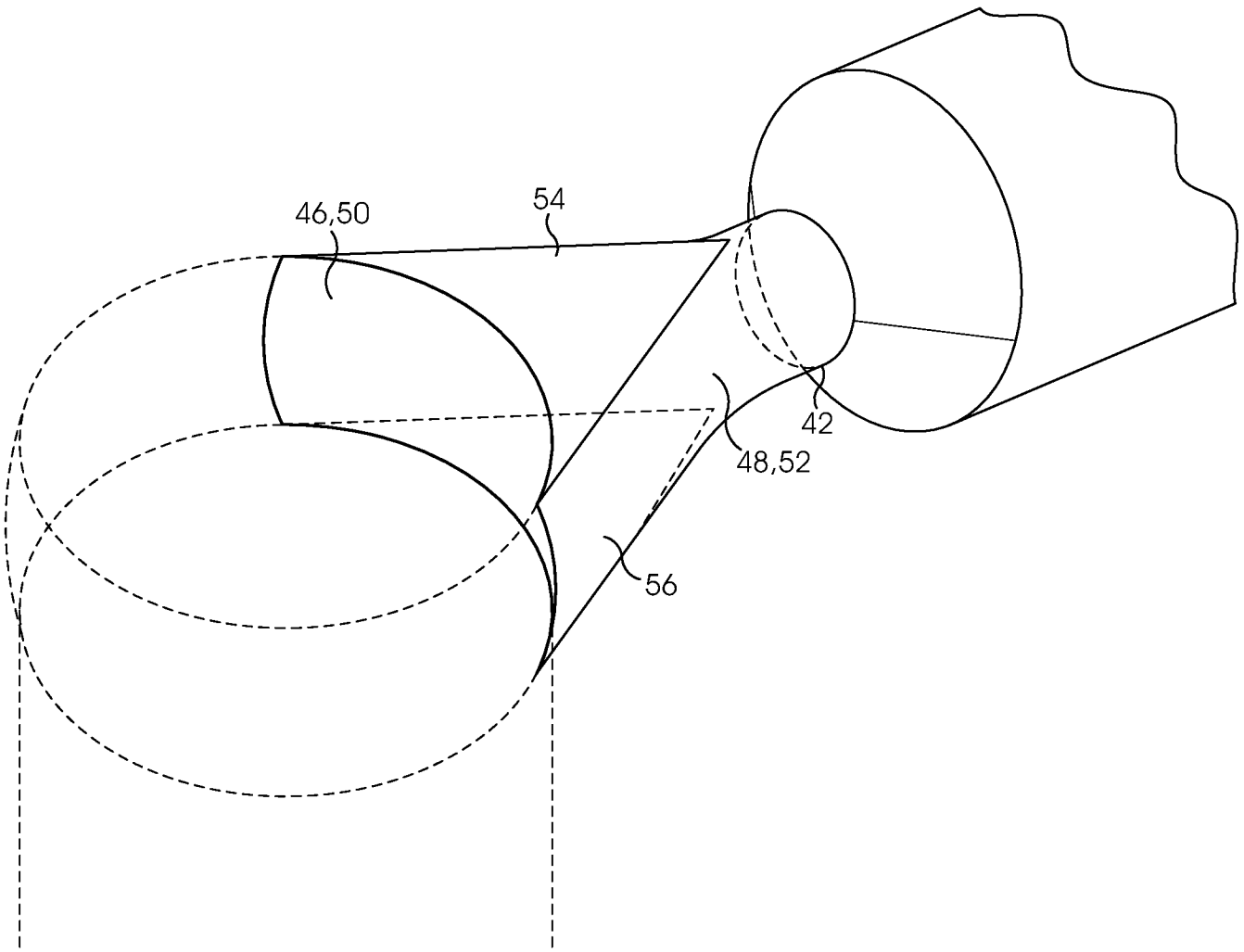
Figure 4:
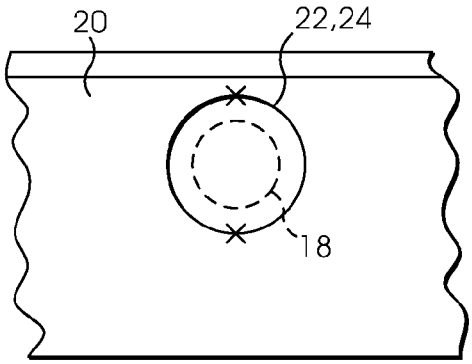
FIG. 4 Prior Art
Figure 5:
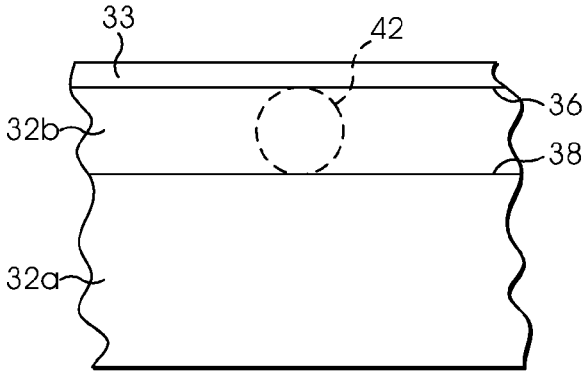
Figure 6:
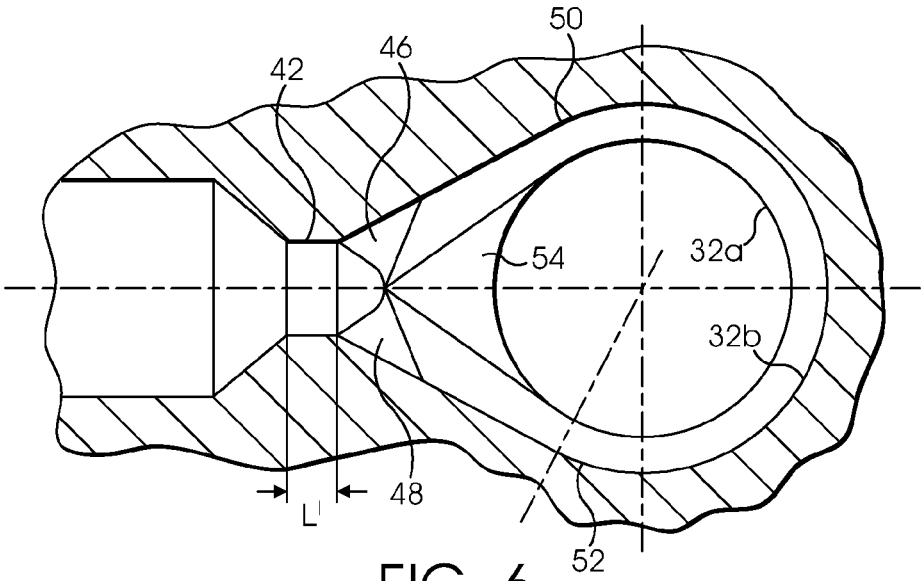
Figure 7:
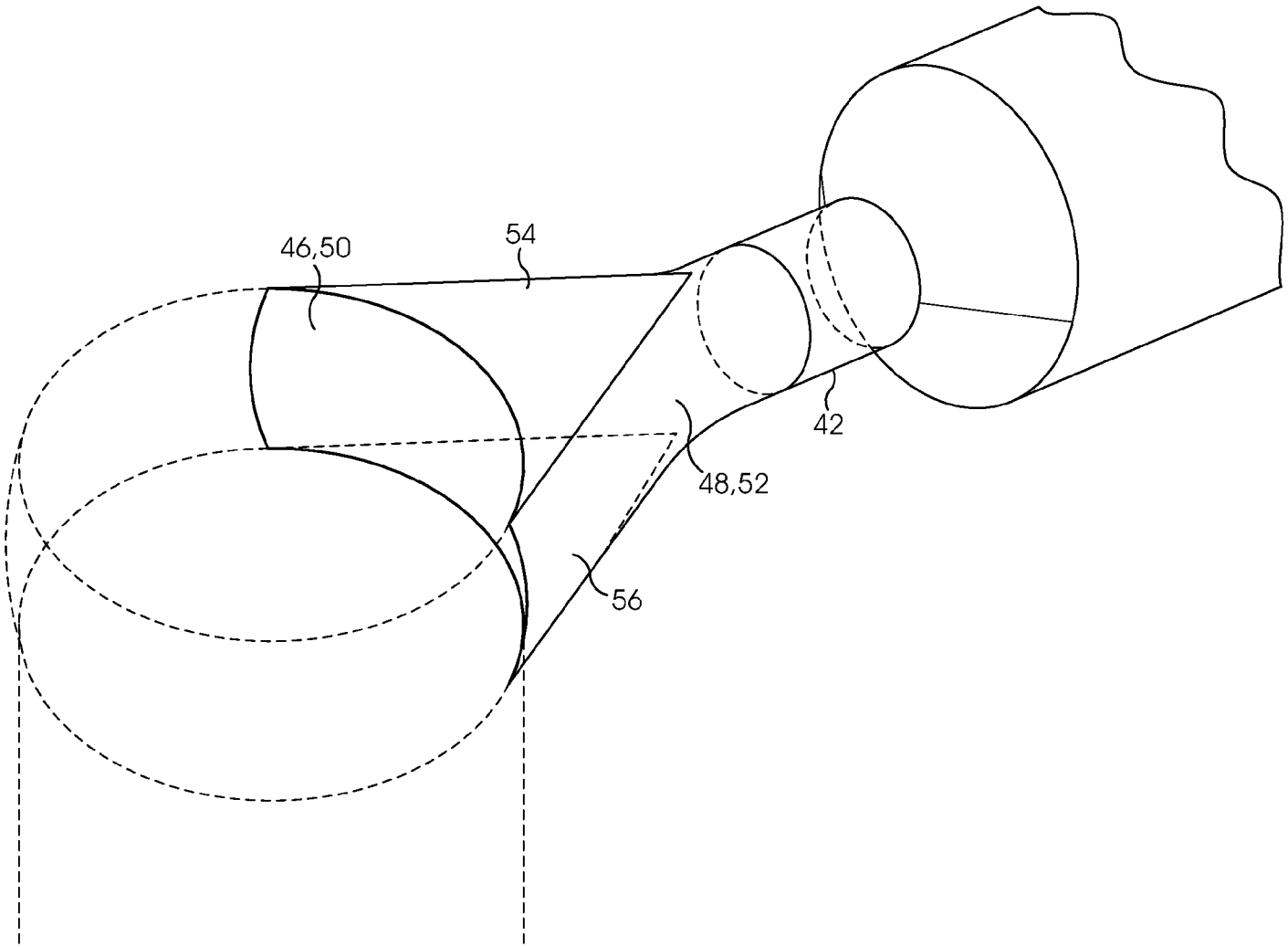

Preferred embodiments of the present invention will now be described, by way of example only, with reference to the accompanying drawings in which:

FIGS. 2(*a*) and 2(*b*) show, by way of comparison with FIGS. 1(*a*) and 1(*b*), cross sections of a part of a pump assembly of a first embodiment of the present invention to illustrate the region of intersection between an outlet drilling for high pressure fuel and a plunger bore recess;

FIG. 3 is a perspective view of the region of intersection in FIGS. 2(*a*) and 2(*b*);

FIG. 4 is a development view of an enlarged recess of the plunger bore, in the region of intersection with the outlet drilling, in the known pump assembly of FIGS. 1(*a*) and 1(*b*); and, by way of comparison with FIG. 4, FIG. 5 is a development view of the plunger bore, in the region of intersection with the outlet drilling, of the pump assembly in FIGS. 2(*a*) and 2(*b*);

FIG. 6 is a cross section of the region of intersection between the plunger bore and the outlet drilling in a second embodiment of the invention; and FIG. 7 is a perspective view of the region of intersection in FIG. 6.

DETAILED DESCRIPTION OF PREFERRED EMBODIMENTS

References in the following description to "upper", "lower" and "side", and other terms having an implied orientation, are not intended to be limiting and refer only to the orientation of the parts shown in the accompanying drawings.

The present invention is applicable to high pressure fluid applications where two drillings carrying high pressure fluid intersect with one another within a region of intersection in a housing.

One particular embodiment of the invention resides in a fuel pump assembly for a common rail fuel injection system. Referring to FIGS. 2(*a*), 2(*b*) and 3, the pump assembly includes a housing 30 in the form of a pump head which is provided with a bore 32 for receiving a plunger (not shown) of the pump assembly. The plunger is arranged to reciprocate, in use, within the plunger bore 32 under the influence of a drive arrangement, as would be familiar to a person skilled in the art. Typically, the pump head is attached to a main pump housing (not shown) of the assembly.

The plunger bore includes two distinct regions: a lower bore region 32*a* of uniform diameter and an upper bore region 32*b* of enlarged diameter, referred to as the plunger bore recess. The plunger bore recess 32*b* connects with an upper conical passage 33, the internal surface of which defines a valve seat for an inlet valve (not shown) to the pump assembly. An upper edge is defined between the conical passage 33 and the plunger bore recess 32*b*, and a lower edge is defined between the plunger bore recess 32*b* and lower bore region 32*a* so that the upper edge defines an upper boundary 36 of the plunger bore recess 32*b* and the lower edge defines a lower boundary 38 of the plunger bore recess 32*b*. The plunger bore recess has a depth, D, defined between the upper and lower boundaries 36, 38. The enlarged diameter of the plunger bore recess 32*b* typically occurs as a result of the method by which the plunger bore is formed within the housing 30 and is a feature of known pump assemblies.

A pump chamber 40 for receiving fuel at low pressure, in use, and within which fuel is pressurised to a high level as the plunger reciprocates, is defined within the plunger bore recess 32*b*. In use of the pump, fuel is delivered to the pump chamber 40 through an inlet passage 41 and is pressurised within the pump chamber 40 during a pumping stroke in which the plunger moves from its lowermost position within the plunger bore (the bottom of its stroke) to its uppermost position within the plunger bore (the top of its stroke).

An outlet drilling 42 from the pump chamber 40 communicates with the plunger bore recess 32*b* and, in use, carries fuel that has been pressurised within the pump chamber 40 to a pump outlet (not shown) which communicates with a downstream common rail (also not shown). The outlet drilling 42 is perpendicular to the plunger bore and has a minimum diameter, d, which is substantially the same as the depth of the plunger bore recess, D. The invention is concerned in particular with the way in which the outlet drilling 42 communicates with the plunger bore recess via a region of intersection 44 between the two.

As shown in the section of FIG. 2(*a*), the intersection region 44 is shaped to include a pair of opposed surfaces 46, 48 of radiused form (referred to as the radiused surfaces), which are provided at the end of the outlet drilling 42. Only one of the radiused surfaces is visible in the section of FIG. 2(*b*). At their ends remote from the outlet drilling 42, the radiused surfaces 46, 48 connect with a corresponding pair of opposed surfaces 50, 52 at a tangent. In turn, the opposed surfaces 50, 52 intersect the circumferential surface of the plunger bore recess 32*b* at a tangent (hence, they are referred to as the tangential surfaces 50, 52) so that the radiused surfaces 46, 48 and the tangential surfaces 50, 52 together define opposed side walls of the intersection region 44.

The intersection region 44 further includes a pair of opposed flat surfaces 54, 56 of triangular-like form, only one of which is visible in the section of FIG. 2(*a*). A first one of the triangular-like surfaces 54 defines the ceiling of the intersection region 44 and a second one of the triangular-like surfaces 56 defines the floor of the intersection region 44. The perspective view of the intersection 44 in FIG. 3 illustrates the arrangement of the radiused surfaces 46, 48, the tangential surfaces 50, 52 and the flat surfaces 54, 56 in more detail. Each triangular-like surface is oriented so that its base 54*a* connects with a respective one of the upper and lower boundaries 36, 38 of the plunger bore recess 32*b* at substantially 90 degrees and its vertex 54*b* opposite the base connects with the end of the drilling 42 where the radiusing starts.

It will be appreciated that the triangular-like surfaces 54, 56 are not of exact triangular form with three straight sides, particularly the bases 54*a* which connect with the circumferential surface of the plunger bore recess 32*b* and so form an arc where they connect. Nonetheless, the surfaces 54, 56 are closed by three line segments linked end-to-end to form a three-sided polygon and so have a triangular-like form.

With the aforementioned shape, the intersection region 44 between the end of the drilling 42 and the plunger bore recess 32*b* is not rotationally symmetric about the axis of the drilling 42, but has mirror symmetry along both the plane through the plunger bore axis and the drilling axis and through a plane at 90° to the aforementioned plane and intersecting the drilling axis.

In comparing FIGS. 1 and 2, which show comparable intersection regions in the known pump assembly and the present invention, respectively, it can be seen that the invention differs significantly from that in the prior art by virtue of the radiused surfaces 46, 48, the tangential surfaces 50, 52 and the triangular-like surfaces 54, 56 of the intersection region 44. In FIG. 1, the intersection region includes a circumferentially continuous blend radius 24 between the conical surface 22 at the end of the outlet drilling 18 and the plunger bore recess 20, with the blend radius 24 breaking into the plunger bore recess 20 itself. In contrast in the present invention, the intersection region 44 includes two distinct radiused surfaces 46, 48 and two tangential surfaces 50, 52 to the plunger bore recess 32*b*, with no blend radius at the end of the intersection region 44 but an intersection region that aligns exactly with the upper and lower boundaries of the plunger bore recess 20 via the flat surfaces 54, 56.

FIGS. 4 and 5 show development views of the plunger bore 12, 20 in the known pump assembly of FIG. 1 and the plunger bore 32*a*, 32*b* in the present invention, respectively. Comparing these figures, it can be seen that the plunger bore recess 32*b* in the present invention is of shallower depth compared to the plunger bore recess 20 in the known pump assembly. Furthermore, the flat surfaces 54, 56 of the intersection region are aligned with the upper and lower boundaries 36, 38 of the plunger bore recess 32*b* so that they align with the plane of the hoop stress within that region, but do not intersect that plane of the hoop stress. By aligning the flat surfaces 54, 56 of the intersection region 44 with the boundaries 36, 38 of the plunger bore recess, and hence with the plane of the hoop stress, there is no stress raising effect at that intersection. This is in contrast to the known pump assembly in FIG. 1, where the radiused surface 24 at the end of the outlet drilling 18 is not aligned with the boundaries of the plunger bore recess 20 and, as a result, hoop stress in this region is increased (indicated at X in FIGS. 1 and 4). The outlet drilling 18 into the plunger bore 12 therefore acts as a stress raiser in the prior art, which can lead to failure of parts due to high pressure fatigue.

It is a further advantage of the invention that the plunger bore recess 32*b* has a reduced depth compared with known pump assemblies, which gives rise to a reduced dead volume of the pump chamber 40 (i.e. the volume of the pump chamber 40 that remains filled with fuel when the plunger is at its uppermost position in the plunger bore, at the end of its stroke). This improves pump output, particularly at high fuel pressures.

FIGS. 6 and 7 illustrate a second embodiment of the invention in which the minimum diameter, d, of the outlet drilling has a longer length, L', compared to that in FIG. 2. In all other respects, the intersection region 44 between the outlet drilling 42 and the plunger bore 32*b* is the same in FIGS. 6 and 7 as it is in FIGS. 2 and 3.

In the embodiments of the invention described previously, the depth of the plunger bore recess 32*b* is substantially the same dimension as the diameter of the outlet drilling 42 at its point of minimum diameter, d. In other words, the depth of the plunger bore recess, D, is substantially the same as the diameter, d, of the outlet drilling 42.

In other embodiments (not shown), these diameters, d, D, need not be exactly equal. For example, the intersection region 44 may have a taper that changes progressively between the outlet drilling 42 and the plunger bore recess 32*b*. The taper may be oriented such that the opposed flat surfaces 54, 56 are converging as they intersect with upper and lower boundaries 36, 38, respectively, or such that the opposed flat surfaces 54, 56 are diverging as they intersect with the upper and lower boundaries 36, 38. In practice, however, the optimum arrangement is as described previously, where the first and second flat surfaces 54, 56 are substantially parallel with one another and substantially perpendicular to the axis of the plunger bore so that the plane of each flat surface aligns with the respective one of the upper and lower boundaries 36, 38.

In still further embodiments of the invention, the first drilling 32*a* with which the second drilling 42 intersects may be of uniform diameter so that there is no enlarged diameter region of the first drilling (i.e. region 32*b* is absent). In this case the intersection region is shaped in a similar manner as described previously, except that there are no boundaries with which the flat surfaces 54, 56 of the intersection region intersect. Instead, the intersection region 44 is provided with the radiused surfaces 46, 48 which form a tangent to the tangential surfaces 50, 52, respectively, which, in turn, form a tangent to the circumference of the first drilling 32*a*. This embodiment may be more applicable to common rail and pump housing applications, rather than the pump head described previously, where the first drilling does not have an enlarged diameter region, as in the case of a bore for a pumping plunger in a pump head.

The invention claimed is:

1. A housing (30) for use in high pressure fluid applications, the housing comprising:

a first drilling (32*a*, 32*b*), defining a first axis, and having a region of enlarged diameter (32*b*) bounded by an upper boundary (36) in a first plane and a lower boundary (38) in a second plane; and a second drilling (42), defining a second axis, and intersecting with the first drilling (32*a*, 32*b*) via an intersection region (44);

wherein the intersection region (44) includes, a first substantially flat surface (54) which defines a ceiling of the intersection region (44) and which intersects the upper boundary (36) with no blend radius, and a second substantially flat surface (56) which is opposed to the first substantially flat surface (56) and which defines a floor of the intersection region (44) and intersects the lower boundary (38) with no blend radius, wherein the first and second substantially flat surfaces (54, 56) are substantially perpendicular to the first axis so as to align with the plane of a respective one of the upper and lower boundaries (36, 38), wherein the first and second axes intersect with one another.

2. A housing as claimed in claim 1, wherein the intersection region (44) further includes side walls defined by first and second opposed tangential surfaces (50, 52) which form a tangent to the circumference of the first drilling (32*a*, 32*b*).

3. A housing as claimed in claim 1, in the form of a housing for a fuel pump assembly, wherein the first drilling (32*a*, 32*b*) is a bore for receiving a plunger of the pump and the second drilling (42) is a passage for conveying high pressure fuel, in use, from the plunger bore (32*a*, 32*b*) to a pump outlet.

4. A housing (30) as claimed in claim 1, wherein the intersection region (44) further includes side walls defined by first and second opposed radiused surfaces (46, 48).

5. A housing as claimed in claim 4, wherein the intersection region (44) further includes side walls defined by first and second opposed tangential surfaces (50, 52) which form a tangent to the circumference of the first drilling (32*a*, 32*b*) and wherein the first and second opposed radiused surfaces (46, 48) form a tangent to a respective one of the first and second opposed tangential surfaces (50, 52).

6. A housing as claimed in claim 1, wherein the intersection region (44) is tapered progressively between the second drilling (42) and the first drilling (32*a*, 32*b*).

7. A housing as claimed in claim 6, wherein the direction of taper is such that the first and second substantially flat surfaces (54, 56) are divergent at their intersection with the upper and lower boundaries (36, 38) of the enlarged diameter region (32*b*), respectively.

8. A housing as claimed in claim 6, wherein the direction of taper is such that the first and second substantially flat surfaces (54, 56) are convergent at their intersection with the upper and lower boundaries (36, 38) of the enlarged diameter region (32*b*), respectively.

9. A housing as claimed in claim 1, wherein the first and second substantially flat surfaces (54, 56) are of triangular-like form.

10. A housing as claimed in claim 9, wherein each of the first and second substantially flat triangular-like surfaces has a base (54*a*) which connects with the respective one of the upper and lower boundaries (36, 38) and a vertex (54*b*) opposite to the base (54*a*) which intersects with an end of the second drilling (42).

* * * * *